US008328311B2

(12) United States Patent
Nakano et al.

(10) Patent No.: US 8,328,311 B2
(45) Date of Patent: Dec. 11, 2012

(54) PRINTING APPARATUS AND PRINTING METHOD

(75) Inventors: Takatoshi Nakano, Tokyo (JP); Kiichiro Takahashi, Yokohama (JP); Tetsuya Edamura, Kawasaki (JP); Toshiyuki Chikuma, Tokyo (JP); Hirokazu Tanaka, Kawasaki (JP); Wakako Yamamoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/851,693

(22) Filed: Aug. 6, 2010

(65) Prior Publication Data

US 2011/0037799 A1 Feb. 17, 2011

(30) Foreign Application Priority Data

Aug. 11, 2009 (JP) ..... 2009-186575

(51) Int. Cl.
*B41J 29/38* (2006.01)

(52) U.S. Cl. ..... 347/12

(58) Field of Classification Search ..... 347/9, 12, 347/14, 15, 40
See application file for complete search history.

(56) References Cited

U.S. PATENT DOCUMENTS

| | | | |
|---|---|---|---|
| 5,280,310 | A | 1/1994 | Otsuka et al. |
| 5,384,587 | A | 1/1995 | Takagi et al. |
| 5,481,281 | A | 1/1996 | Otsuka et al. |
| 5,854,642 | A | 12/1998 | Takahashi et al. |
| 6,099,102 | A | 8/2000 | Tanaka et al. |
| 6,120,129 | A | 9/2000 | Iwasaki et al. |
| 6,149,259 | A | 11/2000 | Otsuka et al. |
| 6,193,344 | B1 | 2/2001 | Otsuka et al. |
| 6,264,305 | B1 | 7/2001 | Inui et al. |
| 6,334,659 | B1 | 1/2002 | Maeda et al. |
| 6,352,327 | B1 | 3/2002 | Yano et al. |
| 6,371,592 | B1 | 4/2002 | Otsuka et al. |
| 6,601,938 | B1 | 8/2003 | Iwasaki et al. |
| 6,629,743 | B2 | 10/2003 | Chikuma et al. |
| 6,764,154 | B2 | 7/2004 | Nishikori et al. |
| 6,808,247 | B2 | 10/2004 | Kawatoko et al. |
| 6,846,066 | B2 | 1/2005 | Teshikawara et al. |
| 6,877,833 | B2 | 4/2005 | Teshigawara et al. |
| 6,960,036 | B1 | 11/2005 | Fujita et al. |

(Continued)

FOREIGN PATENT DOCUMENTS

JP 2007-118300 A 5/2007

(Continued)

OTHER PUBLICATIONS

Communication (Extended European Search Report)—Appln. 10008237.9-2304, European Patent Office, dated Jan. 25, 2011.

(Continued)

*Primary Examiner* — An Do
(74) *Attorney, Agent, or Firm* — Fitzpatrick, Cella, Harper & Scinto

(57) ABSTRACT

Degradation in image quality due to disturbance in landing positions of satellites is suppressed. When scanning and printing with a printing head which has a first nozzle array ejecting relatively large ejection amount of ink, a second nozzle array arranged on one side of the first nozzle array in a scan direction and a third nozzle array arranged on the other side of the first nozzle array in the scan direction, the second and third nozzle arrays ejecting a relatively small ejection amount of ink with the same color, a printing rate of one of the second and third nozzle arrays located at the front side in the scan direction is controlled lower than that of the other located at the back side.

11 Claims, 9 Drawing Sheets

U.S. PATENT DOCUMENTS

| | | | |
|---|---|---|---|
| 6,997,541 | B2 | 2/2006 | Edamura et al. |
| 7,011,391 | B2 | 3/2006 | Otsuka et al. |
| 7,057,756 | B2 | 6/2006 | Ogasahara et al. |
| 7,131,713 | B2 | 11/2006 | Otsuka et al. |
| 7,296,877 | B2 | 11/2007 | Chikuma et al. |
| 7,325,900 | B2 | 2/2008 | Hayashi et al. |
| 7,410,239 | B2 | 8/2008 | Takahashi et al. |
| 7,455,379 | B2 | 11/2008 | Otsuka et al. |
| 7,500,727 | B2 | 3/2009 | Takahashi |
| 7,537,298 | B2 | 5/2009 | Oshio et al. |
| 2006/0044334 | A1 | 3/2006 | Fujita et al. |
| 2008/0273055 | A1 | 11/2008 | Takahashi et al. |
| 2009/0073202 | A1 | 3/2009 | Kanda et al. |
| 2009/0174741 | A1 | 7/2009 | Nagata et al. |

FOREIGN PATENT DOCUMENTS

| | | | |
|---|---|---|---|
| JP | 2009-066972 | A | 4/2009 |
| JP | 2009-154376 | A | 7/2009 |

OTHER PUBLICATIONS

U.S. Appl. No. 12/817,360, filed Jun. 17, 2010.
U.S. Appl. No. 12/836,132, filed Jul. 14, 2010.
U.S. Appl. No. 12/852,118, filed Aug. 6, 2010.

PRINTING APPARATUS AND PRINTING METHOD

BACKGROUND OF THE INVENTION

1. Field of the Invention

The present invention relates to an inkjet printing apparatus and an inkjet printing method.

2. Description of the Related Art

In an inkjet printer, main droplets of ink are ejected from ink ejection ports of a printing head to be landed on a sheet, and in addition thereto, small droplets of ink separated from the main droplets of the ink forming the main droplets are landed on the sheet to form small dots thereon. This small dot is called "satellite". The small droplet forming this satellite is originally ejected together with the main droplet and is formed in such a manner that a tail portion of the main droplet is generated at the back side by tension between the main droplet and a liquid surface of meniscus of an ink ejection bore and is separated from the main droplet for being in a spherical shape with surface tension. In consequence, the small droplet forming the satellite is, as compared to the main droplet, thought to be subjected to more backward forces by surface tension at the time the small dot is pulled away from the meniscus of the ink ejection bore, and an ejection speed of the small droplet is slower than that of the main droplet. Since the main droplet ejected from a large-droplet nozzle array for ejecting relatively large ink droplets has a large dot diameter, the satellite having a slow ejection speed is landed to overlap over the main droplet on a sheet at the time it is landed thereon. On the other hand, since the main droplet ejected from a small-droplet nozzle array for ejecting relatively small ink droplets has a relatively small dot diameter, the satellite having a slow ejection speed is landed away from the main droplet on a sheet at the time it is landed thereon. In this way, since the satellites form dots which are not intended originally, many proposals have been made as technologies for restricting the satellite (for example, refer to Japanese Patent Laid-Open No. 2007-118300), but it is difficult to restrict occurrence of the satellite.

In a printer using the printing head provided with large-droplet nozzle arrays for ejecting relatively large ink droplets and small-droplet nozzle arrays for ejecting relatively small ink droplets, the satellite of the small-droplet nozzle array is landed away from the main droplet as described above. Since the satellite generated in such a printing head has relatively low kinetic energy, a landing position of the satellite to the main ink droplet is disturbed by the self-current generated by ejection of the ink droplet and the flowing current generated by transfer of a carriage. The disturbance in the landing position of the satellite generates density variations to cause image quality to be degraded.

An object of the present invention is to provide a printing apparatus and a printing method capable of suppressing degradation of image quality due to disturbance in landing positions of satellites.

SUMMARY OF THE INVENTION

In a first aspect of the present invention, there is provided a printing apparatus includes a scanning mechanism adapted to scan a print medium with a printing head in a scan direction, the printing head having a first nozzle array ejecting relatively large ejection amount of ink, a second nozzle array arranged on one side of the first nozzle array in the scan direction, and a third nozzle array arranged on the other side of the first nozzle array in the scan direction, the second and third nozzle arrays ejecting a relatively small ejection amount of ink with the same color, respectively, and a controller adapted to control a printing rate of one of the second and third nozzle arrays located at the front side in the scan direction lower than that of the other located at the back side.

In a second aspect of the present invention, there is provided a printing method printing method having a step of scanning a print medium with a printing head, the printing head having a first nozzle array adapted to eject relatively large ejection amount of ink, a second nozzle array arranged on one side of the first nozzle array in a scan direction, and a third nozzle array arranged on the other side of the first nozzle array in the scan direction, the second and third nozzle arrays adapted to eject a relatively small ejection amount of ink with the same color, respectively, and a step of controlling a printing rate of one of the second and third nozzle arrays located at the front side in the scan direction lower than that of the other located at the back side.

Further features of the present invention will become apparent from the following description of exemplary embodiments with reference to the attached drawings.

DESCRIPTION OF THE EMBODIMENTS

Hereinafter, an embodiment of the present invention will be described below in detail with reference to the attached drawings. However, components described in the embodiment are shown only as an example and the scope of the present invention is not limited thereto only.

Figure 1:
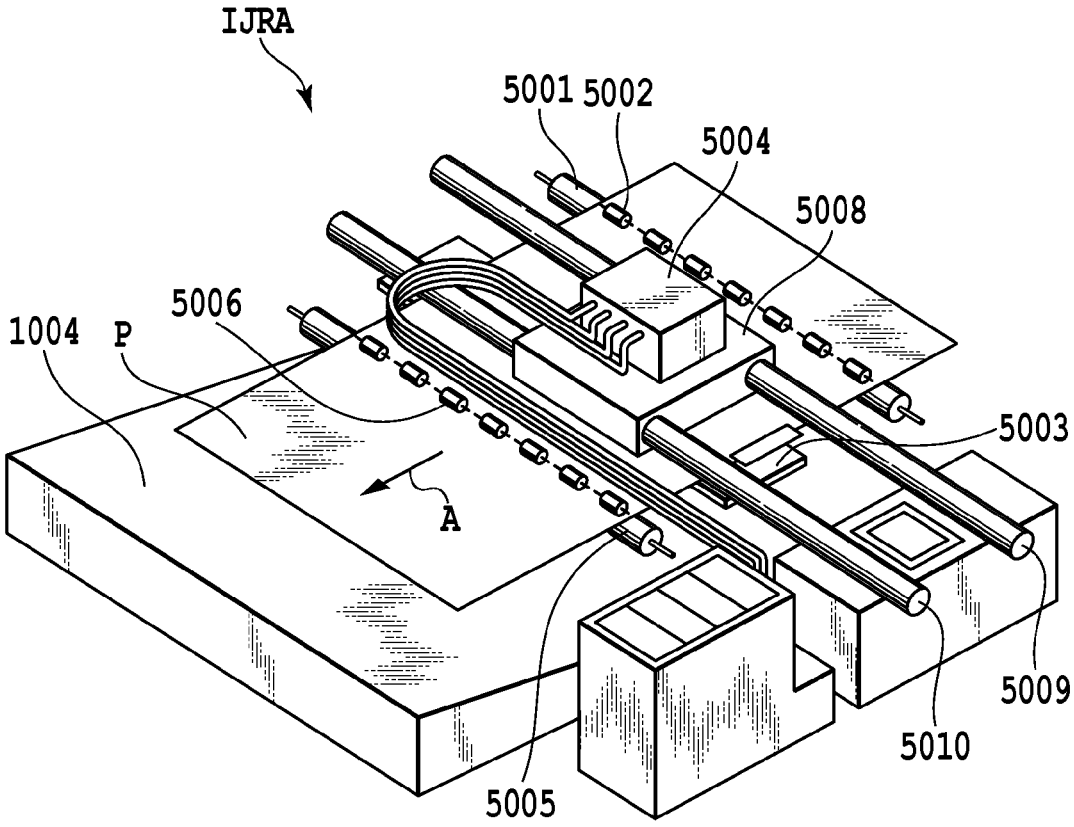
FIG. 1 is a perspective view showing an example of an inkjet printing apparatus to which the present invention is applied.

FIG. 1 is a perspective view showing an arrangement of a printer IJRA as an inkjet printing apparatus to which the present invention is applied. A print medium P is fed to a nipping region formed between a conveying roller 5001, which is disposed on a conveying path of the print medium P, and a pinch roller 5002, which follows the conveying roller 5001 to rotate, by an automated feeding unit. The print medium is subsequently conveyed in a direction of an arrow A (a sub-scan direction) shown in the figure while being guided and supported on a platen 5003. The pinch roller 5002 is resiliently biased toward the conveying roller 5001 by biasing means such as a spring (not shown). The conveying roller 5001 and the pinch roller 5002 are constituent of a first conveying means disposed upstream in a conveying direction.

The platen 5003 is disposed a printing position facing to an ink ejection port formation surface (an ejection surface) of the inkjet-type printing head 5004 to support a reverse side of a print medium P and maintain a constant distance between an obverse side of a print medium P and the ejection surface. After a print medium P is conveyed on the platen and printed an image thereon, the print medium P is nipped between a discharging roller 5005, which is rotating, and a spur 5006 as a rotor, which follows the discharging roller 5005, thereby the print medium P is conveyed in the direction of A and discharged from the platen 5003 to a discharge tray 1004. The discharging roller 5005 and the spur 5006 are constituent of a second conveying means downstream in the conveying direction of the print medium P.

The printing head 5004 is removably mounted on a carriage 5008 so that the ejection surface of the printing head 5004 faces to the platen 5003 or a print medium P thereon. The carriage 5008 is moved back and forth along two guide rails 5009 and 5010 by driving force of a carriage motor. And the printing head 5004 performs an ink ejection operation in accordance with printing data in the back and forth movement.

Figure 2:
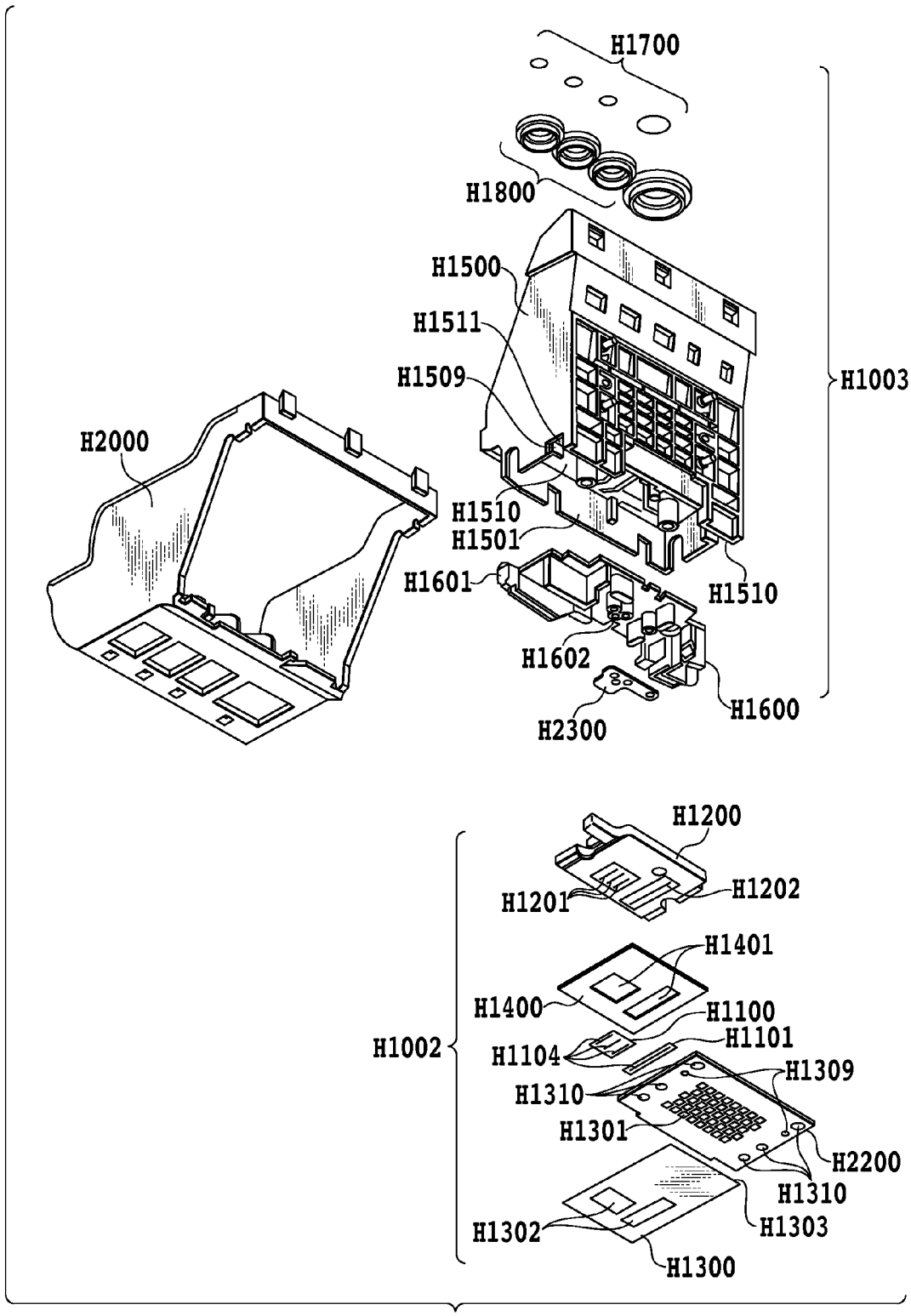
FIG. 2 is an exploded perspective view showing a printing head of the printer in FIG. 1.

FIG. 2 is an exploded perspective view showing the printing head of the printer IJRA. The printing head is a bubble jet (registered trademark) printing head which is a side shooter ejecting liquid droplets in a direction substantially perpendicular to a heater substrate. The printing head 5009 (H1001) includes a print element unit H1002, an ink supply unit H1003 and a tank holder H2000. The print element unit H1002 is configured by a first print element H1100, a second print element H1101, a first plate H1200, an electrical wiring tape H1300, an electrical contact substrate H2200 and a second plate H1400. The ink supply unit H1003 is configured by an ink supply member H1500, a flow passage forming member H1600, a joint rubber H2300, a filter H1700 and a sealing rubber H1800.

In the print element unit H1002, formation of a plate joint body (element substrate) by the jointing of the first plate and the second plate, mount of the print element to the plate joint body, lamination of the electrical wiring tape and electrical joint between the tape and the print element, sealing of the electrical connection portion and the like are carried out in that order. The first plate H1200 in which planarity is required in view of an influence on an ejection direction of the droplet is configured by, for example, an alumina ($Al_2O_3$) material having a thickness of 0.5 to 10 mm. In the first plate H1200, an ink supply port H1202 for supplying ink of black to the first print element H1100 and ink supply ports H1201 for supplying ink of cyan, magenta, yellow, and black are formed.

The second plate H1400 is a single sheet-shaped member having a thickness of about 0.5 to 1 mm and has window-shaped ports H1401 each larger than a contour dimension of each of the first print element H1100 and the second print element H1101 bonded and fixed to the first plate H1200. The second plate H1400 is laminated and fixed with an adhesive agent on the first plate H1200 to form the plate joint body.

The first print element H1100 and the second print element H1101 are bonded and fixed to a surface of the first plate formed in the ports H1401. It is difficult to accurately mount the print element on the first plate due to low positioning accuracy when bonding and fixing the first print element H1100 and the second print element H1101 to the first plate and displacement of the adhesive agent. An assembly error of the printing head can cause a landing deviation of ink to be described below.

Each of the print elements H1100 and H1101 having the print element arrays H1104 is formed of a well known structure as a side shooter bubble jet (registered trademark) substrate. The print elements H1100 and H1101 have ink supply ports, heater arrays and electrode portions. A TAB tape is adopted in the electrical wiring tape (hereinafter, wiring tape) H1300. The TAB tape is formed of a tape substrate (base film), a copper foil wire and a laminated body of a cover layer.

Inner leads H1302 as connection terminals extend in two sections of a device hole corresponding to the electrode portion of the print element. The wiring tape H1300 is bonded and fixed at a side of the cover layer to a surface (tape bonding surface) of the second plate through a thermosetting epoxy plastic bonding layer and the base film of the wiring tape H1300 serves as a smooth capping surface which a capping member of the print element unit is in contact with.

Figure 3:
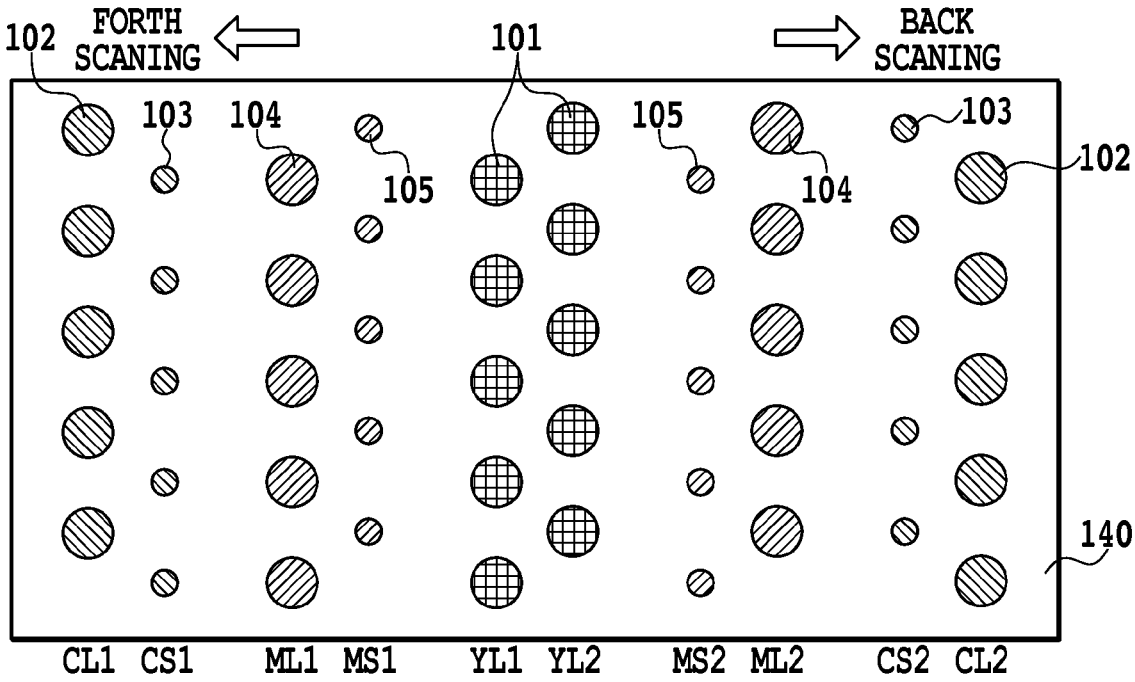
FIG. 3 is a view showing an arrangement of an ink ejection port forming surface of the printing head in the printing apparatus in FIG. 1.

FIG. 3 is a view showing an arrangement of an ink ejection port forming surface of the first print element H1100. A plurality of ink ejection ports 101 for ejecting ink of yellow, a plurality of ink ejection ports 102 and 103 for ejecting ink of cyan and a plurality of ink ejection ports 104 and 105 for ejecting ink of magenta are formed on an ink ejection port forming surface 140. The ink ejection ports 101 are linearly arranged in two arrays in a direction intersecting with a scan direction of the printing head to form a nozzle array YL1 and a nozzle array YL2. The ink ejection ports 102, 103, 104 and 105 in one side (forth scan) of the nozzle array YL1 are arranged to be symmetrical with the ink ejection ports 102, 103, 104 and 105 in the other side (back scan) of the nozzle array YL2 in a scan direction. The plurality of the ink ejection ports 102 in the forth scan side form the nozzle array CL1. The plurality of the ink ejection ports 103 in the forth scan side form the nozzle array CS1. The plurality of the ink ejection ports 104 in the forth scan side form nozzle array ML1. The plurality of the ink ejection ports 105 in the forth scan side form the nozzle array MS1. The plurality of the ink ejection ports 102 in the back scan side form nozzle array CL2. The plurality of the ink ejection ports 103 in the back scan side form the nozzle array CS2. The plurality of the ink ejection ports 104 in the back scan side form the nozzle array ML2. The plurality of the ink ejection ports 105 in the back scan side form the nozzle array MS2. The nozzle arrays CL1 and CL2, and the nozzle arrays ML1 and ML2 form large-droplet nozzle arrays including ink ejection ports for ejecting relatively large ink droplets. The nozzle arrays CS1 and CS2, and the nozzle arrays MS1 and MS2 form small-droplet nozzle arrays including ink ejection ports for ejecting relatively small ink droplets. Further, the ink droplet ejected from the nozzle arrays CS1, CS2, MS1 and MS2 is smaller than the ink droplet ejected from the nozzle arrays YL1 and YL2.

Figure 4:
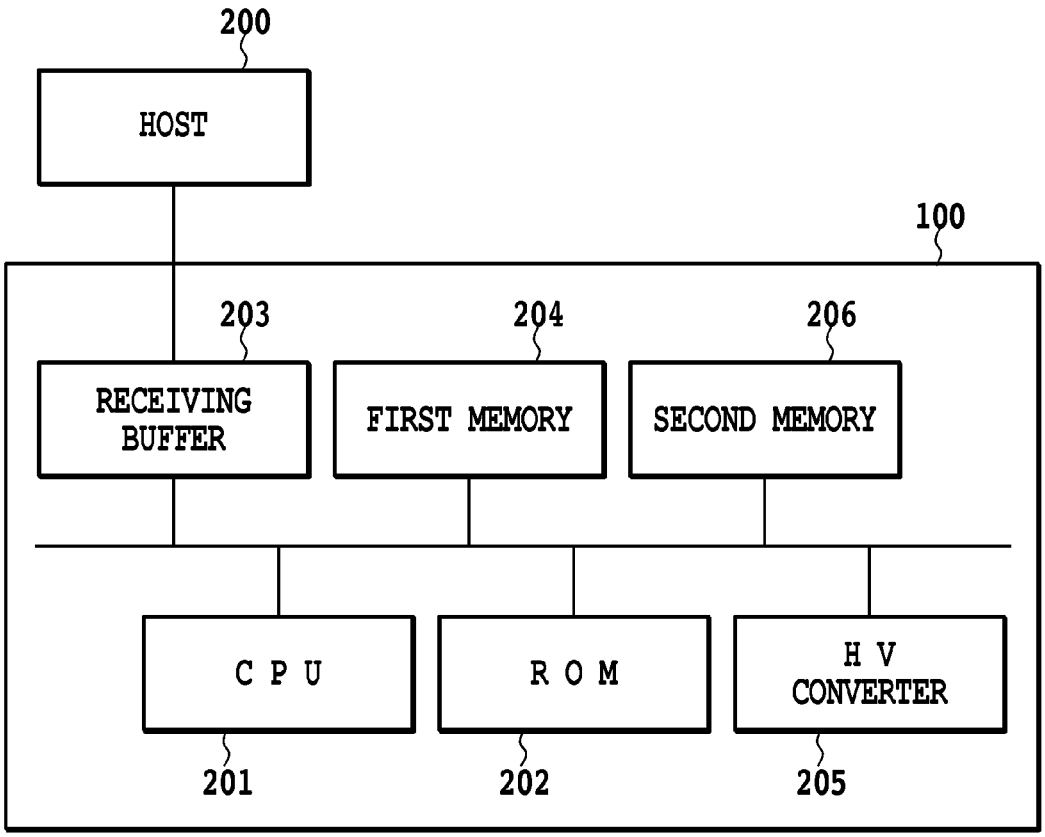
FIG. 4 is a block diagram showing an arrangement of a control system in the printing apparatus in FIG. 1.

FIG. 4 is a block diagram showing an arrangement of a control system in the printer. A control system 100 in the printer includes a CPU 201, a ROM 202, a receiving buffer 203, a first memory 204, a HV converter 205 and a second memory 206. The CPU 201 integrally controls the printer. A rotation of each of a carriage motor for driving the carriage 5008 to move, a conveying motor for driving the conveying roller 5001 and the discharging roller 5005 and the like is controlled by the CPU 201 through a motor driver. In addition, the CPU 201 controls a head driver in accordance with printing data so that each of the ejection ports of the printing head 5004 ejects ink. Further, the CPU 201 serves as setting means for setting a printing rate of each nozzle array in a printing method as described below. The ROM 202 stores control programs executed by the CPU 201 and a plurality of masks as well. The masks have mutually different printing rates. The receiving buffer 203 stores print data in a raster unit received from a host 200. The print data stored in the receiving buffer 203 are compressed for reducing a transmission data amount from the host 200, which are stored in the first memory 204 after developed. The print data stored in the first memory 204 are subjected to HV conversion processing by the HV converter 205 and are stored in the second memory 206.

Next, a printing method according to the first embodiment in the present invention will be explained. It should be noted that in the present embodiment, there is explained an example of a two-path print where a print of an image to a unit region of the print medium is completed by one back and forth scan to the unit region, that is, two scans to the unit region. In the present embodiment, there is explained a case of using the nozzle arrays YL1 and YL2 and the nozzle arrays MS1 and MS2.

In the printing method of the present embodiment, a ratio between a printing rate of the nozzle array MS1 and a printing rate of the nozzle array MS2 is changed corresponding to a scan direction of the printing head. Specifically among the nozzle arrays MS1 and MS2, the printing rate of the nozzle array located at the front side in each scan direction is set smaller than the printing rate of the nozzle array located at the backward side. Herein, the printing rate is defined as a rate of pixels being allowable to be output (printed) with respect to all pixels in a unit area. In a general method for altering the printing rate, a mask pattern defining whether to allow an ejection of an ink droplet to each pixel is applied to binary printing data defining whether to eject an ink droplet to each pixel. The printing method of the present embodiment is a so-called bi-directional multi-path printing method in which a print to a unit region on a print medium is completed by at least one back and forth scan to the unit area. In this multi-path printing method, a rate (ratio) of print data of which output (print) is permitted for each scan is in advance determined by a mask.

Figure 5:
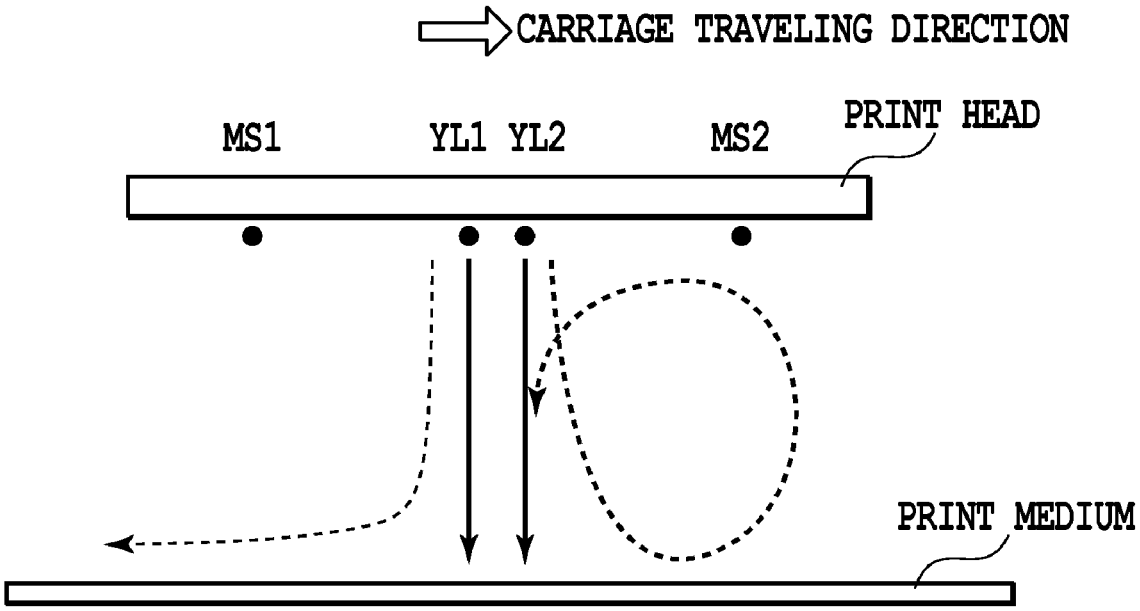
FIG. 5 is a view schematically explaining a state of flows generated between the printing head and a print medium.

Here, an operation of the printing method in the present embodiment will be explained. As shown in FIG. 5, when ink is ejected from the nozzle arrays YL1 and YL2 having relatively large ink droplets, a swirl having a fast speed is generated at a forward area (side of the nozzle array MS2) in a carriage traveling direction (scan direction) of the nozzle arrays YL1 and YL2 and as a result, air flow therein tends to be easily disturbed. On the other hand, since not a swirl having a fast speed but only a swirl having a slow speed is generated at a backward area (side of the nozzle array MS1) in the carriage traveling direction of the nozzle arrays YL1 and YL2, the disturbance of the air flow is relatively small. Therefore, when ink of magenta is ejected from the nozzle array MS2, the satellite formed from main droplets is influenced by the disturbed air flow, so that the landing deviation of the satellite on a print medium tends to be easily generated. On the other hand, when the ink of magenta is ejected from the nozzle array MS1, since the disturbance of the air flow is small, the landing deviation of the satellite formed from the main droplet on the print medium is difficult to be generated.

Therefore, in the present embodiment, a printing rate of the nozzle array located at the front side in each scan direction of the nozzle arrays MS1 and MS2 is set to be lower than a printing rate of the nozzle array located at the backward side, thereby suppressing the landing deviation of the satellite. That is, in the present embodiment, to the first nozzle array ejecting ink of a relatively large ejection amount, the printing rates of the second nozzle array and the third nozzle array which are arranged respectively to the forward side and the backward side in the scan direction of the first nozzle array and which eject ink of a relatively small ejection amount are set as described above. It should be noted that herein, each of the second nozzle array and the third nozzle array may be the nozzle array ejecting ink of the same color, and the first nozzle array may be the nozzle array ejecting ink of the same color as or of a color different from the color of the second nozzle array and the third nozzle.

As described above, in the arrangement where a plurality of nozzle arrays including the first to third nozzle arrays are arranged along the scan direction, two or more of the first nozzle arrays are sequentially arranged in the scan direction, and the second and third nozzle arrays respectively are arranged adjacent to the first nozzle array at both sides of the first nozzle array, the printing method of the present embodiment is particularly suitable. This is because in such a configuration, the air flow from the two sequential nozzle arrays each having large ink droplets is very influential and the landing deviation in the satellite of each of the second and third nozzle arrays can be suppressed by setting the printing rates of the second and third nozzle arrays as described above.

Table 1 shows an example of printing rates in each scan direction in the present embodiment. In this example, in the forth scan, the printing rate of the nozzle array MS1 is set as 0%, and the printing rate of the nozzle array MS2 is set as 50%, and in the back scan, the printing rate of the nozzle array MS1 is set as 50%, and the printing rate of the nozzle array MS2 is set as 0%.

TABLE 1

| | | Nozzle array name | | | |
|---|---|---|---|---|---|
| | | MS1 | YL1 | YL2 | MS2 |
| Printing rate[%] | Forth scan | 0 | 25 | 25 | 50 |
| | Back scan | 50 | 25 | 25 | 0 |

Table 2 shows an example as a comparative example in a case where the printing rates of the nozzle arrays MS1 and MS2 are equally distributed for a print.

TABLE 2

| | | Nozzle array name | | | |
|---|---|---|---|---|---|
| | | MS1 | YL1 | YL2 | MS2 |
| Printing rate[%] | Forth scan | 25 | 25 | 25 | 25 |
| | Back scan | 25 | 25 | 25 | 25 |

Figure 6:
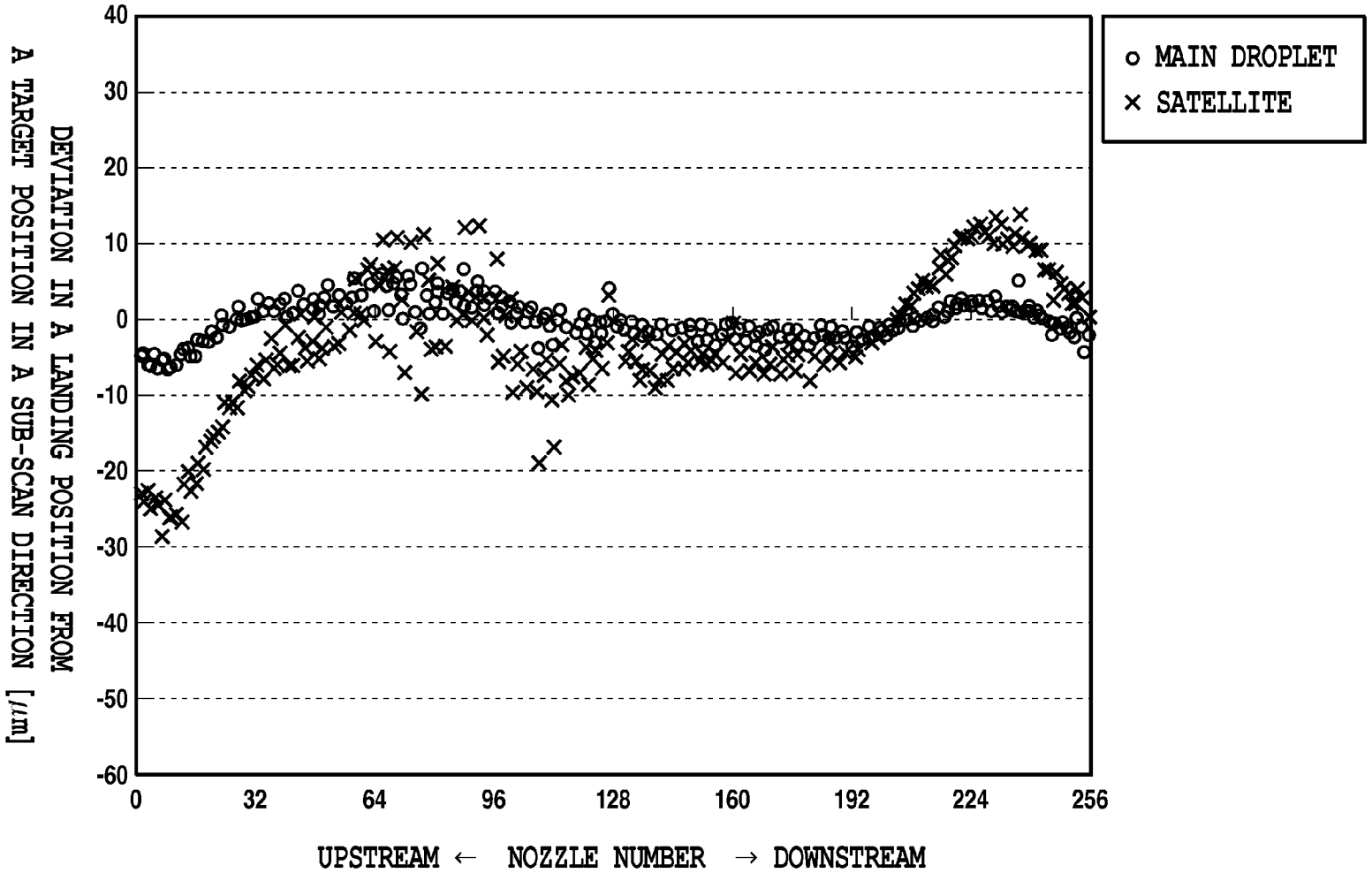
FIG. 6 is a graph showing deviation amounts in landing positions between main droplets and satellites according to an embodiment of the present invention.
Figure 7:
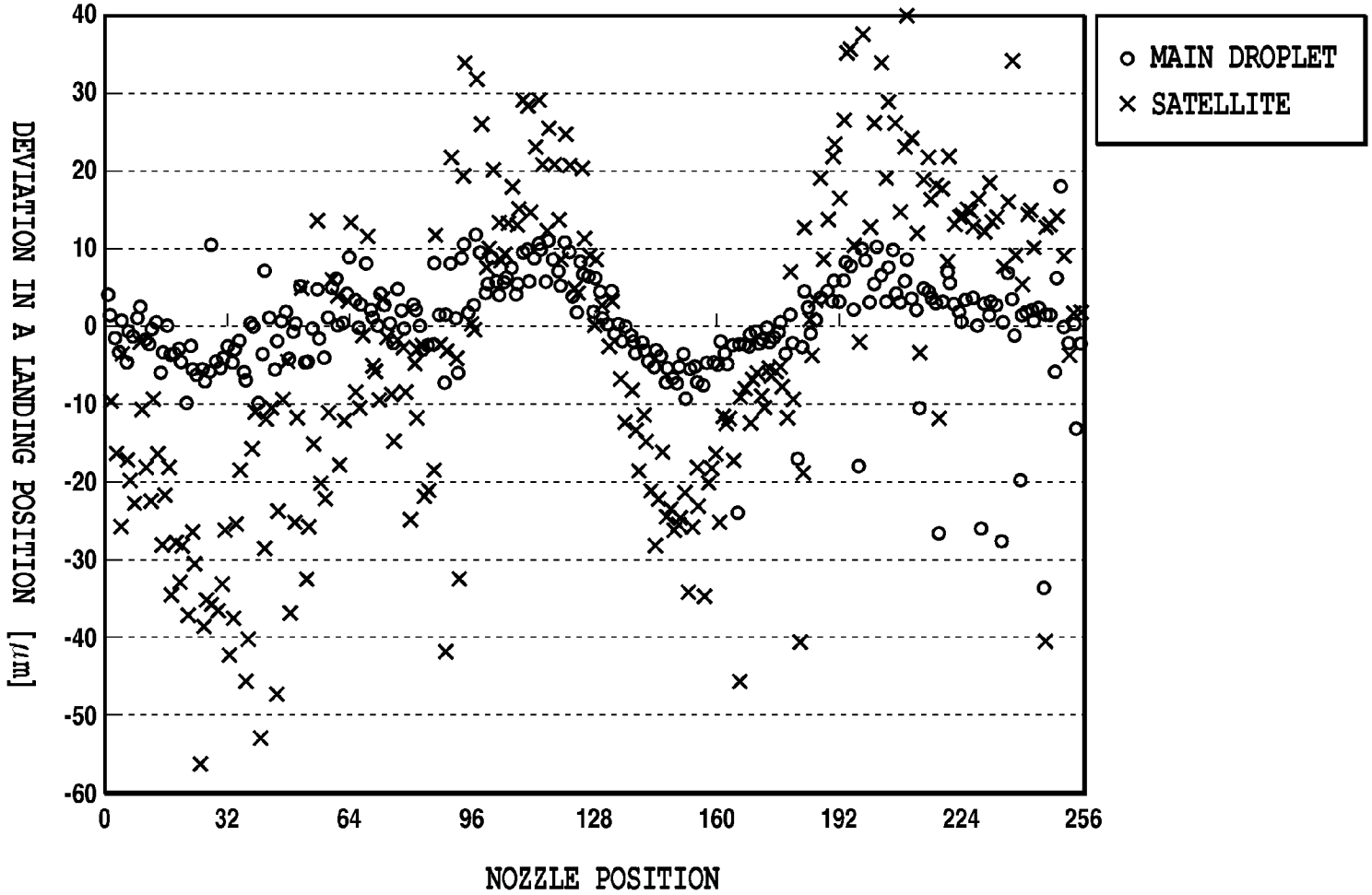
FIG. 7 is a graph showing deviation amounts in landing positions between main droplets and satellites according to a comparative example.

FIG. 6 is a graph showing deviation amounts in landing positions from target positions of main droplets and satellites in a sub-scan direction when printing in the condition shown in Table 1. FIG. 7 is a graph showing deviation amounts in landing positions from target positions of main droplets and satellites in a sub-scan direction when printing in the condition shown in Table 2. As apparent from a comparison between FIG. 6 and FIG. 7, according to the printing method of the present embodiment shown in FIG. 6, it is found out that the deviation amount in the landing position of the satellite can be largely suppressed.

It should be noted that in the example in Table 1, one of the printing rates of the nozzle arrays MS1 and MS2 is set as 0% and the other is set as 50%, but for example, as shown in Table 3, the one may be set as 37.5% and the other may be set as 12.5%.

TABLE 3

| | | Nozzle array name | | | |
|---|---|---|---|---|---|
| | | MS1 | YL1 | YL2 | MS2 |
| Printing rate[%] | Forth scan | 12.5 | 25 | 25 | 37.5 |
| | Back scan | 37.5 | 25 | 25 | 12.5 |

Table 4 shows another example of printing rates in each scan direction in the present embodiment. The example in Table 4 adopts the nozzle arrays YL1 and YL2, the nozzle arrays MS1 and MS2, and the nozzle arrays CS1 and CS2. As shown in Table 4, one of the printing rates in the nozzle arrays of magenta close to yellow is set as 35% and the other is set as 15%. Further, since cyan distant from yellow is difficult to be influenced by air flow due to ejection of the yellow ink, both of the printing rates in the nozzle arrays of the cyan can be respectively set as 25%.

TABLE 4

| | | Nozzle array name | | | | | |
|---|---|---|---|---|---|---|---|
| | | CS1 | MS1 | YL1 | YL2 | MS2 | CS2 |
| Printing rate[%] | Forth scan | 25 | 15 | 25 | 25 | 35 | 25 |
| | Back scan | 25 | 35 | 25 | 25 | 15 | 25 |

Figure 8:
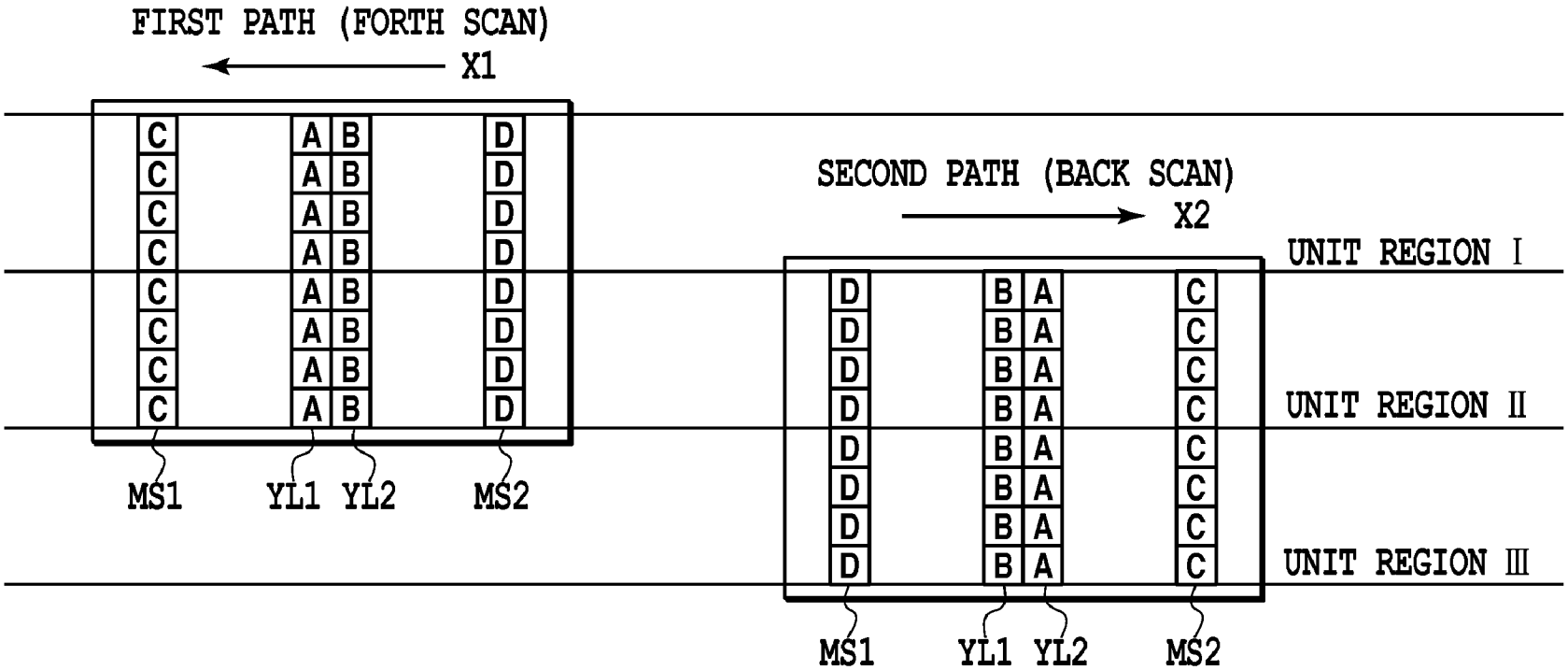
FIG. 8 is a view for schematically explaining a printing method according to an embodiment of the present invention.

Here, in the present embodiment, a printing method when setting a printing rate of each of the nozzle arrays as described above will be explained. FIG. 8 is a view for schematically explaining the printing method of the present embodiment. The printing method of the present embodiment is a multi-path printing method of bi-directional and two-path in which an image printed to a unit region on a print medium is completed by two scans (one back and forth scan) to the unit region. In FIG. 8, in a unit region II, a print by the forth direction scan of an arrow X1 is performed in the first path, and a print by the back direction scan of an arrow X2 is performed in the second path.

Each of the nozzle arrays MS1, YL1, YL2 and MS2 having 128 nozzles is divided into 8 blocks respectively having 16 nozzles in the sub-scan direction. One type of mask pattern is given to one block of the 8 blocks for every print by one scan. Alphabets A to D in FIG. 8 are indicative of an application of masks A to D illustrated in FIG. 9 thereto. In addition, a print medium is conveyed in Y-direction (the sub-scan direction) by a length of the four blocks (64 nozzles).

Figure 9:
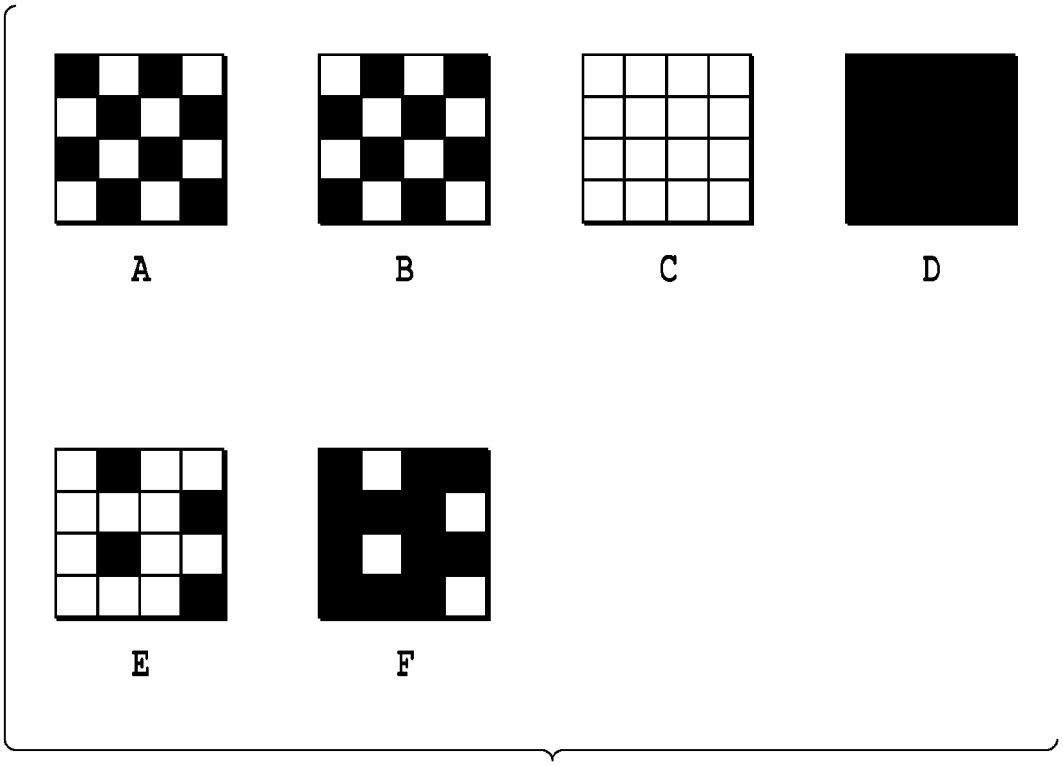
FIG. 9 is a view illustrating masks used for the two-path printing of FIG. 8.

FIG. 9 illustrates mask patterns used for the bi-directional two-path printing of FIG. 8. Each of the mask patterns is configured with arrangements of permissive printing pixels and/or nonpermissive printing pixels. Each of the mask patterns is four pixels in size in the main-scan direction and the sub-scan direction, and is repeatedly used for each of the blocks in each of the nozzle arrays in the main-scan direction and the sub-scan direction. The masks A and B are two different mask patterns having a mutually exclusive and complementary relationship. The masks C and D are also two different mask patterns having a mutually exclusive and complementary relationship. The masks A to D are used when printing using the printing rates of Table 1. The masks A and B are mask patterns defining a printing rate of 25%, the mask C is a mask pattern defining a printing rate of 0%, and the mask D is a mask pattern defining a printing rate of 50%.

Referring again to FIG. 8, the masks A and B are applied to the nozzle arrays YL1, YL2. In particular, to the nozzle array YL1, the mask A is applied in the first path, and the mask B is applied in the second path. On the other hand, to the nozzle array YL2, the mask B is applied in the first path, and the mask A is applied in the second path. As a result, printing with the printing rate shown in Table 1 can be performed.

The masks C and D are applied to the nozzle arrays MS1, MS2. In particular, to the nozzle array MS1, the mask C is used in the first path, and the mask D is used in the second path. The mask C has no permissive printing pixel, so all of printing data given to the nozzle array MS1 is printed in the second path using the mask D. On the other hand, to the nozzle array MS2, the mask D is used in the first path, and the mask C is used in the second path. Accordingly, all of printing data given to the nozzle array MS2 is used in the first path. As a result, it can be possible to lower the printing rate of the nozzle array MS1 and to increase the printing rate of the nozzle array MS2 in the forth scan, and to increase the printing rate of the nozzle array MS1 and to decrease the printing rate of the nozzle array MS2 in the back scan, as shown in Table 1.

In addition, when printing the unit regions I and III, the masks used for the unit region II are used for the first and second paths in reversal order. As described above, printing to each of the unit regions I to III can be performed by printing with the masks A to D, which are assigned to the respective nozzle arrays, as shown in FIG. 8.

In a case where the printing rates of Table 3 are used, masks E and F shown in FIG. 8 can be used in palace of the masks C and D. The mask E defines a printing rate of 12.5% and the mask F defines a printing rate of 37.5%. By using the masks E and F, a setting of the printing rates of Table 3 can be realized.

Next, a printing method according to a second embodiment in the present invention will be explained. It should be noted that in the present embodiment, there will be explained an example of a two-path print where a print of an image to a unit region on a print medium is completed by one back and forth scan, that is, two scans to the unit region. In the present embodiment, there will be explained a case where in addition to the nozzle arrays YL1 and YL2 and the nozzle arrays MS1 and MS2, the nozzle arrays ML1 (fourth nozzle array) and ML2 (fifth nozzle array) are used.

In the printing method, the printing rates in the nozzle arrays ML1 and MS1 and the printing rates in the nozzle arrays ML2 and MS2 change depending on a scan direction of the printing head. In particular, the printing rate in the nozzle array MS1 (or MS2) located at the forward position in each scan direction is set to be smaller than the printing rate in the nozzle arrays MS2 (or MS1) located at the backward position. In addition to it, the printing rate in the nozzle array ML1 (or ML2) located at the forward position in each scan direction is set to be higher than the printing rate in the large-droplet nozzle array of the nozzle array ML2 (or ML1) located at the backward position.

The reason for increasing the printing rate of the nozzle array ML1 (or ML2) as the large-droplet nozzle array located at the forward side in each scan direction is to suppress an influence of air flow on the nozzle array MS1 (MS2) located at the backward side thereof. That is, the printing rate of the nozzle array ML1 is 50% in the forth scan, but the nozzle array MS1 is difficult to be influenced by the air flow of the nozzle array ML1 since the nozzle array MS1 is located at the back side of the nozzle array ML1 in the scan direction, to restrict the landing deviation of the satellite in the nozzle array MS1. The printing rate of the nozzle array ML2 is 0%, but the nozzle array MS2 is easy to be influenced by the air flow of the nozzle array ML2 since the nozzle array MS2 is located at the forward side of the nozzle array ML2 in the scan direction, to suppress the landing deviation of the satellite in the nozzle array MS2. In the back scan also, the landing deviation of the satellite of each of the nozzle arrays MS1 and MS2 can be likewise suppressed.

It should be noted that if each of the fourth nozzle array and the fifth nozzle array is larger in an ejection amount that each of the second nozzle array and the third nozzle array, a magnitude relation of the ejection amounts thereof with the ejection amount of the first nozzle array is not limited to the above relation. For example, each ejection amount of the fourth and fifth nozzle arrays may be larger than each ejection amount of the second nozzle array and the third nozzle array and may be smaller than that of the first nozzle array.

In this way, the present embodiment is applied to a case where the fourth nozzle array located at an opposing side of the first nozzle array to the second nozzle array in a scan direction and the fifth nozzle array located at an opposing side of the first nozzle array to the third nozzle array in a scan direction are used for a print. In addition, in the printing head where the second nozzle array and the fourth nozzle array are positioned adjacent to each other and the third and fifth nozzle arrays are positioned adjacent to each other, the influence of the air flow from the fourth and fifth nozzle arrays to the second nozzle array and the third nozzle array is large, and the above printing method is particularly effective.

Table 5 and Table 6 show examples in each scan direction in the present embodiment.

TABLE 5

| | | Nozzle array name | | | | | |
|---|---|---|---|---|---|---|---|
| | | ML1 | MS1 | YL1 | YL2 | MS2 | ML2 |
| Printing rate[%] | Forth scan | 50 | 0 | 25 | 25 | 50 | 0 |
| | Back scan | 0 | 50 | 25 | 25 | 0 | 50 |

TABLE 6

| | | Nozzle array name | | | | | |
|---|---|---|---|---|---|---|---|
| | | ML1 | MS1 | YL1 | YL2 | MS2 | ML2 |
| Printing rate[%] | Forth scan | 35 | 15 | 25 | 25 | 35 | 15 |
| | Back scan | 15 | 35 | 25 | 25 | 15 | 35 |

Table 7 shows another example in each scan direction in the present embodiment. Table 7 shows a case of using all the nozzle arrays.

TABLE 7

| | | Nozzle array name | | | | | | | | | |
|---|---|---|---|---|---|---|---|---|---|---|---|
| | | CL1 | CS1 | ML1 | MS1 | YL1 | YL2 | MS2 | ML2 | CS2 | CL2 |
| Printing rate[%] | Forth scan | 40 | 7.5 | 35 | 12.5 | 25 | 25 | 37.5 | 15 | 42.5 | 10 |
| | Back scan | 10 | 42.5 | 15 | 37.5 | 25 | 25 | 12.5 | 35 | 7.5 | 40 |

It should be noted that a definition of the printing rate in each path of each embodiment may be made as software of the CPU, and may be provided by appropriate hardware, for example, as a part of a circuit arrangement of an ASIC.

In the above-mentioned embodiment, among the multi-path printing methods where the printing head performs plural times of scans in a unit region for printing, the multi-path print of two paths is explained. However, the present invention is not limited thereto, and a one-path print or a more-path print may be applicable. The above embodiment shows an example where in the bi-directional printing method, the printing rate of each of the second nozzle array and the third nozzle array (or fourth nozzle array and fifth nozzle array) is reversed depending on the scan direction, but in a one-way printing method, the printing rate of each of the second to fourth nozzle arrays may be fixed.

Further, the landing deviation of the satellite can be reduced by making the printing rates of the second nozzle array and the third nozzle array differ, but the effect of printing one raster with different nozzles is reduced. Therefore, when the influence of the air flow of the first nozzle array ejecting large ink droplets is large, that is, when the print rate of the first nozzle array is high, the printing rates of the second nozzle array and the third nozzle array may be made different. For example, in a print mode where the multi-path number (number of times of scans for completing a print in a unit region) is relatively small, the printing rates of the second nozzle array and the third nozzle array may be made different, and in a print mode where the multi-path number is relatively large, the printing rates of the second nozzle array and the third nozzle array may be made equal. In addition, also when performing a print at the same path number, it is determined whether the print duty of the first nozzle array is more than or less than a predetermined value, and the printing rates of the second nozzle array and the third nozzle array may be made different depending on the determination result. In this arrangement, the CPU 201 analyzes the print data to determine the print rate of each of the nozzle arrays YL1 and YL2 for setting the printing rate of each of the second nozzle array and the third nozzle array, but the print duty may be determined based upon any of the multi-valued print data and the binary print data.

Further, in the embodiment described above, an explanation was made in the case where a two-path print is employed as a multi-path print and a printing rate of 50% is given to each pat. However, a total of printing rates given to respective scans in a multi-path print may be greater than or smaller than 100%.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-186575, filed Aug. 11, 2009, which is hereby incorporated by reference herein in its entirety.

What is claimed is:

1. A printing apparatus comprising:

a scanning unit configured to reciprocally scan, along a scanning axis, a printing head relative to a print medium, wherein the printing head comprises:

a first nozzle array which ejects first ink droplets, a second nozzle array arranged on a side of the first nozzle array, crossing the scanning axis, and which ejects second ink droplets which are smaller than the first ink droplets, and a third nozzle array arranged on an opposite side of the first nozzle array, crossing the scanning axis, and which ejects third ink droplets which are smaller than the first ink droplets; and a controller configured to control printing rates of the second and third nozzle arrays, such that a printing rate of a nozzle array, which is one of the second and third nozzle arrays, located on a side of the first nozzle array in a direction of scan of the printing head, is lower than a printing rate of a nozzle array, which is the other of the second and third nozzle arrays, located on a side of the first nozzle array in an opposite direction of scan of the printing head.

2. The printing apparatus according to claim 1, wherein the printing apparatus performs printing by reciprocally scanning the print medium with the printing head while ejecting ink onto the print medium, and wherein the controller changes the printing rates of each of the second and third nozzle arrays depending on the scan direction.

3. The printing apparatus according to claim 1, wherein the printing head further comprises:

a plurality of nozzle arrays arranged between the second nozzle array and the third nozzle array, wherein ink droplets ejected from the plurality of nozzle arrays are larger in size than the second and third ink droplets ejected from the second and third nozzle arrays, respectively.

4. The printing apparatus according to claim 1, wherein the printing head further comprises:

a plurality of nozzle arrays, which includes the first, second, and third nozzle arrays, wherein the second and third nozzle arrays are arranged adjacent to the first nozzle array, respectively.

5. The printing apparatus according to claim 1, wherein the printing apparatus completes printing to a unit region on the printing medium by multiple scans of the unit region with the printing head, and wherein the controller is further configured to control the printing rates of the second and third nozzle arrays such that:

(i) the printing rate of the nozzle array, which is one of the second and third nozzle arrays, located on the side of the first nozzle array in the direction of scan of the printing head, is lower than the printing rate of the nozzle array, which is the other of the second and third nozzle arrays, located on the side of the first nozzle array in the opposite direction of scan of the printing head, for a first number of scans, and (ii) the printing rates of the second and third nozzle arrays are equal for a second number of scans, larger than the first number of scans.

6. The printing apparatus according to claim 1, wherein the controller is further configured to control the printing rates of the second and third nozzle arrays, such that (i) the printing rate of the nozzle array, which is one of the second and third nozzle arrays, located on the side of the first nozzle array in the direction of scan of the printing head, is lower than the printing rate of the nozzle array, which is the other of the second and third nozzle arrays, located on the side of the first nozzle array in the opposite direction of scan of the printing head, when a printing rate of the first nozzle array is equal to or greater than a predetermined value, and (ii) the printing rates of the second and third nozzle arrays are equal, when the printing rate of the first nozzle array is less than the predetermined value.

7. The printing apparatus according to claim 1, wherein the printing head further comprises:

a fourth nozzle array arranged on the side of the first nozzle array, and a fifth nozzle array arranged on the opposite side of the first nozzle array, wherein the controller is further configured to control printing rates of the fourth and fifth nozzle arrays, such that a printing rate of a nozzle array, which is one of the fourth and fifth nozzle arrays, located on the side of the first nozzle array in the direction of scan of the printing head is higher than a printing rate of a nozzle array, which is the other of the fourth and fifth nozzle arrays, located on the side of the first nozzle array in the opposite direction of scan of the printing head.

8. The printing apparatus according to claim 7, wherein the printing head further comprises:

a plurality of nozzle arrays, which includes the first to fifth nozzle arrays, wherein the second nozzle array is arranged adjacent to the fourth nozzle array, and the third nozzle array is arranged adjacent to the fifth nozzle array.

9. The printing apparatus according to claim 1, wherein the second ink droplets and the third ink droplets are the same in color.

10. The printing apparatus according to claim 1, wherein the second ink droplets and the third ink droplets are substantially the same in size.

11. A printing method comprising the steps of:

scanning a printing head, along a scanning axis, relative to a print medium, the printing head comprising:

a first nozzle array which ejects first ink droplets, a second nozzle array arranged on a side of the first nozzle array, crossing the scanning axis, and which ejects second ink droplets which are smaller than the first ink droplets, and a third nozzle array arranged on an opposite side of the first nozzle array, crossing the scanning axis, and which ejects third ink droplets which are smaller than the first ink droplets; and controlling printing rates of the second and third nozzle arrays, such that a printing rate of a nozzle array, which is one of the second and third nozzle arrays, located on a side of the first nozzle array in a direction of scan of the printing head, is lower than a printing rate of a nozzle array, which is the other of the second and third nozzle arrays, located on a side of the first nozzle array in an opposite direction of scan of the printing head.

* * * * *